US006487958B2

(12) United States Patent
Sugiura et al.

(10) Patent No.: US 6,487,958 B2
(45) Date of Patent: Dec. 3, 2002

(54) METHOD FOR FORMING A FILM ON A CONSTITUENT PART IN A COMPRESSOR

(75) Inventors: Manabu Sugiura, Kariya (JP); Hiroaki Kayukawa, Kariya (JP); Kazuaki Iwama, Kariya (JP); Naohiko Isomura, Kariya (JP); Shigeki Kawachi, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/764,559

(22) Filed: Jan. 18, 2001

(65) Prior Publication Data

US 2001/0017078 A1 Aug. 30, 2001

(30) Foreign Application Priority Data

Feb. 22, 2000 (JP) ..... 2000-044715

(51) Int. Cl.[7] ..... F01B 3/00; F01B 31/10
(52) U.S. Cl. ..... 92/71; 92/155
(58) Field of Search ..... 92/71, 155

(56) References Cited

U.S. PATENT DOCUMENTS 5,941,160 A 8/1999 Kato et al. ..... 92/155

FOREIGN PATENT DOCUMENTS

| | | | |
|---|---|---|---|
| EP | 0 943 800 A1 | 9/1999 | ..... F04B/27/08 |
| JP | 10-26081 | 1/1998 | ..... F04B/39/00 |
| JP | 11-173263 | 6/1999 | ..... F04B/27/08 |

*Primary Examiner*—Edward K. Look
*Assistant Examiner*—Michael Leslie
(74) *Attorney, Agent, or Firm*—Morgan & Finnegan, LLP

(57) ABSTRACT

The object of the present invention is to form a film of a high quality on a constituent part in a compressor.

The compressor has a swash plate as a constituent part to be filmed. The swash plate on which the film is to be formed is arranged on a seat of a film forming device. An adhesive layer is formed to the end surfaces of the swash plate in advance. A sheet to form a film is absorbed to a hollow body of a suction device of the film forming device, and press-contacted to the swash plate. The sheet is thus adhered to the end surface of the swash plate.

7 Claims, 7 Drawing Sheets

26
27
28
29
19
23
111
17
171
18B
33
32
18A
173
141
151
16
13
221
231
192
201
191
202
211
172
24
121
152
30
44
45
31
15
14
12
11
20
21
22
25
153

38
39
40
41
411
412
413
371
43
15
152
42
36
37
34
35

15
44
152
38
40
41
411
39
43
15
42
36
43
37
371
34
35

METHOD FOR FORMING A FILM ON A CONSTITUENT PART IN A COMPRESSOR

BACKGROUND OF THE INVENTION

The present invention relates to a constituent part in a compressor and a method for forming a film on the constituent part in a compressor.

Methods for coating a lubricating coating material on constituent parts such as a swash plate and a piston in a compressor are disclosed in Japanese Unexamined Patent Publications No.10-26081 and No.11-173263.

In a roller coating method according to Japanese Unexamined Patent Publication No.10-26081, a coating material is applied on a peripheral surface of a metal roller, and the coating material on the metal roller is transferred on a peripheral surface of a printing roller, which is made of a synthetic rubber, and then the coating material transferred on the peripheral surface of the printing roller is applied to a piston. The metal roller contacts the printing roller, and the printing roller contacts the piston to be coated. The coating material on the metal roller is adjusted to be predetermined thickness by a comma roller before transferred to the printing roller.

In a pad method according to Japanese Unexamined Patent Publication No.11-173263, a coating material prepared on a concave printing plate at a predetermined thickness and in a predetermined shape is transferred to a pad, and the coating material on the pad is printed on the constituent part to be coated.

In a coating method according to Japanese Unexamined Patent Publication No.10-26081, a line is formed on a coating film passing between a comma roller and a metal roller when a foreign substance is got into a clearance therebetween. This line is transferred to the film applied on the piston, so the quality of the film is deteriorated. As long as the foreign substance is not removed, the line is formed on every film of a subsequent piston to be filmed.

In a coating method according to Japanese Unexamined Patent Publication No.11-173263, a film is creased if the pad is deformed ununiformly. When a contacting surface of the pad with the constituent part is plane, a film is not satisfactorily formed since air is involved therebetween. When the contacting surface of the pad is in a convex curved shape so that it prevents air from being involved in, the thickness of the film is not uniform. For the closer to the center of the contacting surface it is, the stronger the contacting force of the pad against the constituent part becomes. Therefore, the film needs to be dried, calcinated, and then polished so that the thickness of it is adjusted.

SUMMARY OF THE INVENTION

Accordingly, it is an object of the present invention to form a film of a high quality on a constituent part in a compressor.

To achieve the above object, the present invention relates to a method for forming a film on a region of the constituent part, and the film is formed by adhering a sheet to form a film to the region so as to fit the shape of the region.

Furthermore, the present invention has following features. The sheet, which is fitted to the shape of the region, is formed. Afterward the sheet is adhered to the region, whereby the film is formed. The film of a uniform thickness is easily formed.

Furthermore, the present invention has following features. The sheet is a resin sheet containing a solid lubricant. The resin sheet containing the solid lubricant is effective to form a film so as to improve slidability.

Furthermore, the present invention relates to the constituent part in the compressor, and the film is formed in the region of the constituent part. According to the present invention, the film of a uniform thickness is easily formed, and adhered to the constituent part in the compressor.

Furthermore, the present invention has following features. The compressor is a swash plate type compressor, and the constituent part is the swash plate. The swash plate is integrally rotated with a drive shaft. The rotation of the swash plate through the shoes is converted into the reciprocating movement of pistons. The region to be filmed is the sliding region of the swash plate to the shoes. The sliding region of the swash plate to the shoes is suitable for the region to be filmed.

Furthermore, the present invention has following features. An adhesive layer is arranged on the region to be filmed, and the sheet is adhered over the region through the adhesive layer. When the adhesive layer is arranged on the region in advance, it is easy to adhere the sheet to the region.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

FIG. 1(*a*) is an enlarged partial cross-sectional view of FIG.

FIG. 2(*a*) is an enlarged cross-sectional view of a suction device in FIG. 2;

FIG. 3(*a*) is a front view illustrating an adhesive layer arranged on an end surface in FIG. 3;

FIG. 6(*b*) is a cross-sectional view illustrating the condition that the absorption roller contacts the feeding plate;

FIG. 6(*c*) is a cross-sectional view illustrating the condition that the sheet to form a film is adhered on a peripheral surface of the absorption roller;

FIG. 7(*b*) is a cross-sectional view illustrating the condition that the absorption roller contacts the swash plate;

FIG. 7(*c*) is a cross-sectional view illustrating the condition that the sheet to form a film is adhered to the swash plate;

DETAILED DESCRIPTION OF THE PREFERRED EMBODIMENTS

A first embodiment according to the present invention will now be described with reference to FIGS. 1 to 3.

Figures 1, 1A:
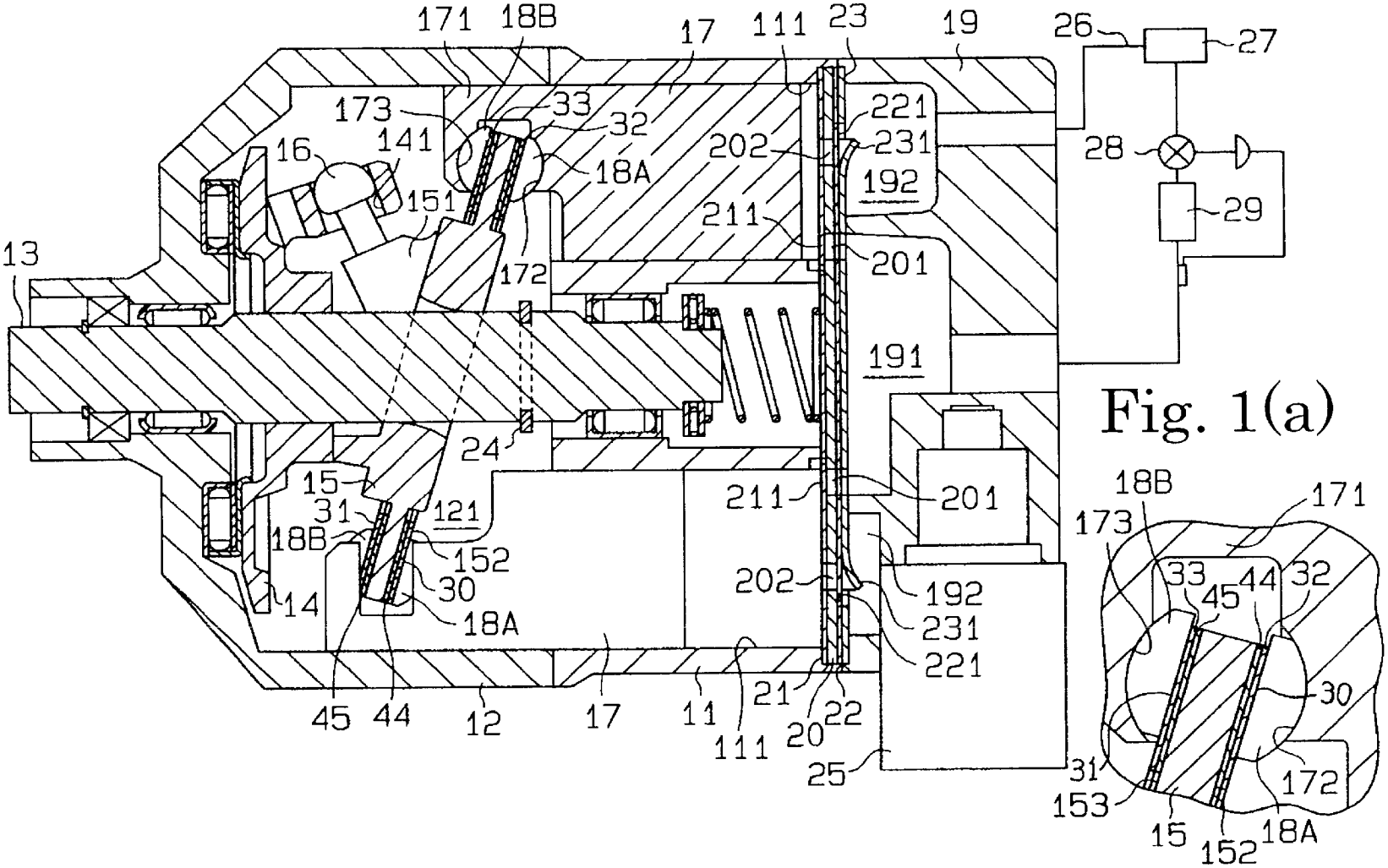
FIG. 1 is a cross-sectional side view illustrating a compressor according to a first embodiment of the present invention.

An inner construction of a variable displacement compressor is illustrated in FIG. 1. A cylinder block 11 is connected to a rear end of a front housing 12 and to a front end of a rear housing 19. The cylinder block 11, the front housing 12, and the rear housing 19 constitute a housing assembly. A drive shaft 13 is inserted in the front housing 12 and the cylinder block 11 forming a crank chamber 121. The drive shaft 13 receives the drive power from the outer driving source such as a vehicle engine. A rotary support member 14 is mounted around the drive shaft 13, and a swash plate 15 is supported slidably and inclinably in the axial direction of the drive shaft 13. A pair of brackets 151 is integrally formed with the swash plate 15 made of steel, and a pair of guide pins 16 is mounted on the bracket 151. The guide pin 16 is slidably inserted into a respective guide hole 141 formed on the rotary support member 14. The swash plate 15 is rotated integrally with the drive shaft 13 and inclinably in the axial direction of the drive shaft 13 by the association between the guide hole 141 and the guide pin 16. The inclination of the swash plate 15 is guided by the slide guide relation between the guide hole 141 and the guide pin 16, and by a slide support of the drive shaft 13.

The inclination of the swash plate 15 is adjusted under the pressure control in the crank chamber 121. When the pressure in the crank chamber 121 increases, the inclination of the swash plate 15 decreases. When the pressure in the crank chamber 121 decreases, the inclination of the swash plate 15 increases. The refrigerant in the crank chamber 121 flows into a suction chamber 191 in a rear housing 19 through a pressure release passage, which is not illustrated. The refrigerant in a discharge chamber 192 in the rear housing 19 is supplied into the crank chamber 121 through a pressure supply passage, which is not illustrated. A capacity control valve 25 is arranged in the pressure supply passage, and the flow rate of the refrigerant supplied from the discharge chamber 192 to the crank chamber 121 is adjusted by the capacity control valve 25. When the flow rate of the refrigerant increases, the pressure in the crank chamber 121 increases. When the flow rate of the refrigerant decreases, the pressure in the crank chamber 121 decreases. That is, the inclination of the swash plate 15 is adjusted by the capacity control valve 25.

The abutment between the swash plate 15 and the rotary support member 14 regulates the maximum inclination of the swash plate 15. The abutment between a circular clip 24 around the drive shaft 13 and the swash plate 15 regulates the minimum inclination of the swash plate 15.

A plurality of cylinder bores 111 (only two of the cylinder bores are illustrated in FIG. 1) are arranged around the drive shaft 13 in the cylinder block 11. A piston 17 is accommodated in each cylinder bore 111. As shown in FIG. 1 the piston 17 at the upper side is at the top dead center, and the piston 17 at the lower side is at the bottom dead center. The rotating movement of the swash plate 15 integrally rotated with the drive shaft 13 is converted into the back-and-forth reciprocating movement of the piston 17 through a pair of semi-spherical shoes 18A and 18B, and the piston 17 moves back and forth in the cylinder bore 111. The shoe 18A made of steel slides on one sliding surface 30 of the swash plate 15, and the shoe 18B made of steel slides on another sliding surface 31 of the swash plate 15.

The suction movement of the piston 17 (the movement from right to left in FIG. 1) draws the refrigerant in the suction chamber 191 into the cylinder bore 111 through an intake port 201 of a valve plate 20, pushing away a suction valve 211 of a suction valve plate 21. The discharge movement of the piston 17 (the movement from left to right in FIG. 1) discharges the refrigerant in the cylinder bore 111 into the discharge chamber 192 through a discharge port 202 of the valve plate 20, pushing away a discharge valve 221 of a discharge valve plate 22. A retainer 231 of a retainer plate 23 regulates the opening degree of the discharge valve 221 by the abutment therebetween.

The discharge chamber 192 and the suction chamber 191 are connected through an external refrigerant circuit 26. The refrigerant in the discharge chamber 192 flows outside the compressor, through a condenser 27, an expansion valve 28 and an evaporator 29 in the external refrigerant circuit 26, and returns to the suction chamber 191.

A connecting portion 171 is formed on the piston 17, and a pair of semi-spherical concave portions 172 and 173 is formed on the connecting portion 171. As shown in FIG. 1(*a*), the shoe 18A sliding on one sliding surface 30 of the swash plate 15 is held in the concave portion 172 to be fitted therein, and the shoe 18B sliding on another sliding surface 31 of the swash plate 15 is held in the concave portion 173 to be fitted therein.

Films 32 and 33 are formed on the end surfaces 152 and 153 which are film formed regions of the sliding surfaces 30, 31 of the swash plate 15. The film 32 is adhered to the end surface 152 through an adhesive layer 44, and the film 33 is adhered to the end surface 153 through an adhesive layer 45. The surface of the film 32 forms the sliding surface 30, and the surface of the film 33 forms the sliding surface 31. The films 32 and 33 are made of thermosetting resin containing solid lubricants such as molybdenum disulfide, tungsten disulfide and graphite. The adhesive layers 44 and 45 are made of adhesives of thermosetting resin.

Figures 2, 2A:
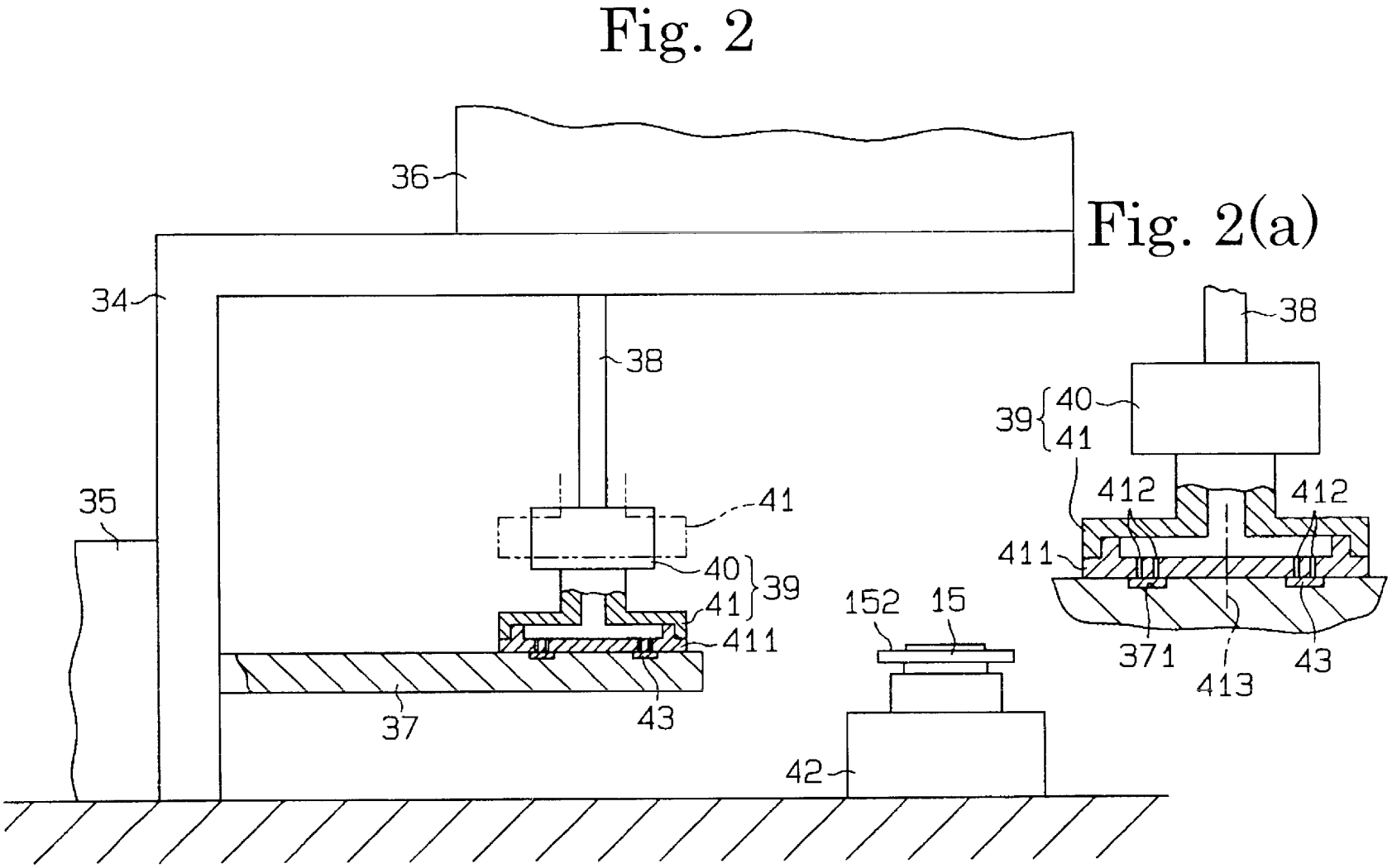
FIG. 2 is a cross-sectional view illustrating a film forming device.

The films 32 and 33 are formed by the film forming device as shown in FIG. 2. A first driving device 35 and a second driving device 36 are mounted on a base frame 34. A feeding plate 37, which is horizontally arranged, is reciprocated by the first driving device 35. The feeding plate 37 is horizontally reciprocated at a predetermined height. The feeding plate 37 is reciprocated between the feeding position shown in FIG. 2 and the preparing position shown in FIG. 3. An annular holding slot 371 is recessed on the feeding plate 37.

A suction device 39 is mounted beneath a support shaft 38 which is vertically and horizontally moved by the second driving device 36. As shown in FIG. 2(*a*), the suction device 39 is composed of a blower 40 and a cylindrical hollow body 41, and a plurality of suction bores 412 are arranged in a bottom wall 411 of the hollow body 41 annularly around an axial line 413 of the hollow body 41.

A seat 42 is arranged on the extended position of the feeding plate 37. The swash plate 15 on which films are to be formed is arranged on the seat 42. In FIGS. 2 and 3, a swash plate 15 is mounted on the seat 42 so that the end surface 152 is upward.

Figures 3, 3A:
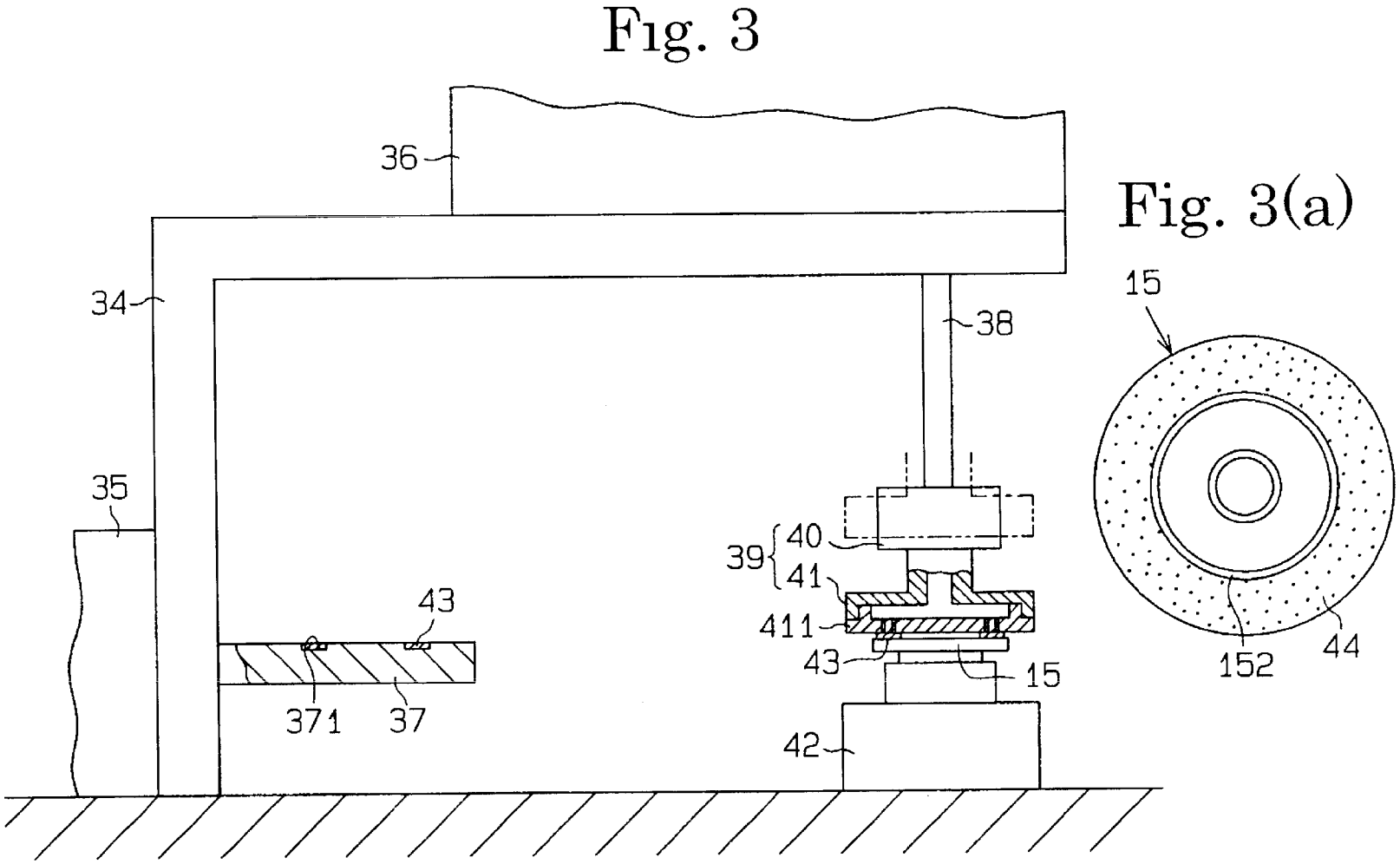
FIG. 3 is a cross-sectional view illustrating adhesion of a sheet to form a film to a swash plate.

When the feeding plate 37 is at the preparing position shown in FIG. 3, an annular sheet 43 to form a film is supplied into a holding slot 371. The sheet 43 is made of thermosetting resin containing the solid lubricants such as molybdenum disulfide, tungsten disulfide and graphite, and is formed in predetermined thickness in advance. When the feeding plate 37 which holds the sheet 43 in the holding slot 371 is at the feeding position shown in FIG. 2, the suction device 39 is lowered to the solid line position from the chain line position in FIG. 2. At the lowered position, the bottom wall 411 of the hollow body 41 is abutted to the feeding plate 37, and then a blower 40 operates. The blower 40 generates a suction force at the suction bore 412, and the sheet 43 is absorbed to the bottom wall 411. The suction device 39 absorbing the sheet 43 is raised to the chain line position in FIG. 2, and is moved horizontally to the chain line position in FIG. 3. The suction device 39 is lowered to the solid line position in FIG. 3, and the end surface 152 of the swash plate 15 is contacted by the sheet 43. Then the blower 40 stops operation. As shown in FIG. 3(*a*), the adhesive layer 44 is formed on the end surface 152 of the swash plate 15 in advance. The adhesive layer 45 is also formed on the end surface 153 of the swash plate 15. The sheet 43 is adhered to the end surface 152 through the adhesive layer 44 by press-contacting to the end surface 152.

Once the sheet 43 is adhered to the end surface 152, the suction device 39 is moved to the solid line position in FIG. 2 through the chain line positions in FIGS. 3 and 2. Then the new sheet 43 on the holding slot 371 is absorbed to the bottom wall 411 of the hollow body 41. The swash plate 15 is turned over so that the end surface 153 is upward. The new sheet 43 absorbed to the bottom wall 411 of the hollow body 41 is adhered to the end surface 153 as well as to the end surface 152.

Then the swash plate 15 adhered the sheets 43 and 44 is sent to the calcination process. The sheets 43 on the end surfaces 152 and 153 become the films 32 and 33 through the calcination process.

In the first embodiment the following effects can be obtained.

(1-1) The sheets 43 adhered to the end surfaces 152 and 153 are, for example, formed from a strip-shaped thermosetting resin sheet by a blanking. Such thermosetting sheet is formed by dispersing the fluid thermosetting resin in a sheet on the surfaces of a glass or a stainless plate and the like, and then drying. The strip-shaped thermosetting resin sheet is simply made so that the sheet has a desired and uniform thickness. Accordingly, the method for forming the films 32 and 33 by adhering the sheet 43 is effective to provide the films 32 and 33 having a desired and uniform thickness.

(1-2) When the thickness of the sheet 43 is predetermined in consideration of the change of the film thickness accompanied by calcinating the films 32 and 33, the surface of the films 32 and 33 do not need to be polished to adjust the film thickness.

(1-3) The resin containing the solid lubricant is effective to form the films 32 and 33 which can improve the slidability.

(1-4) The end surfaces 152 and 153 of the swash plate 15 are plane. The adhesion of the sheet to the plane is easier than to the curved surface. Accordingly, the end surfaces 152 and 153, which are sliding regions of the swash plate 15 to the pair of shoes 18A and 18B, are suitable for the regions to form the films 32 and 33 by adhering the sheet 43.

Next, a second embodiment will be explained with reference to FIGS. 4 to 9. The same reference numerals as the first embodiment are given to the components which are common to the first embodiment.

Figure 4:
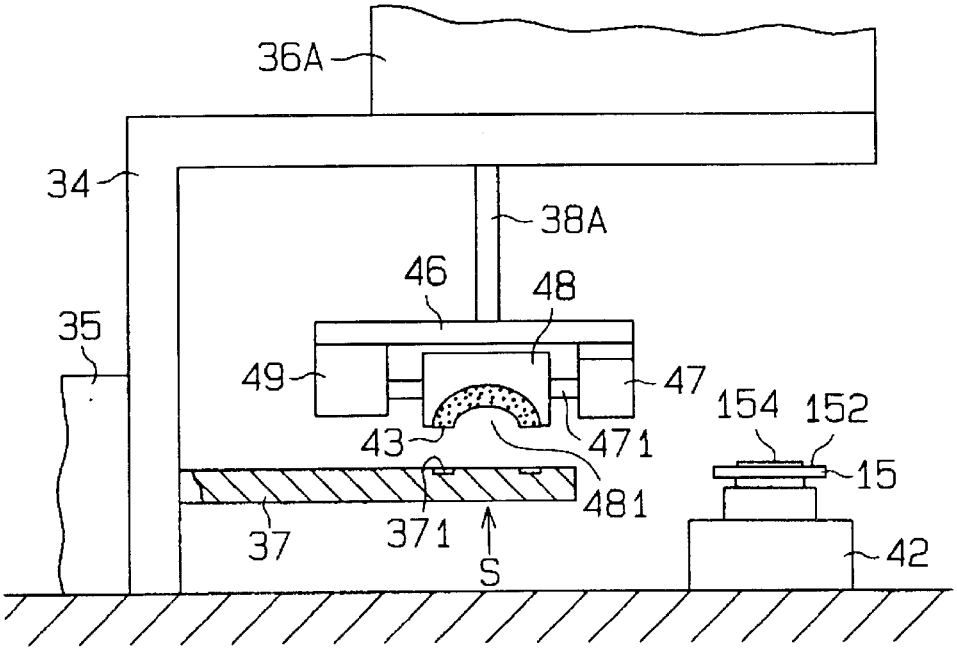
FIG. 4 is a partially omitted front view illustrating a second embodiment and a support shaft extending from a second driving device, at a position over a feeding plate.
Figure 5:
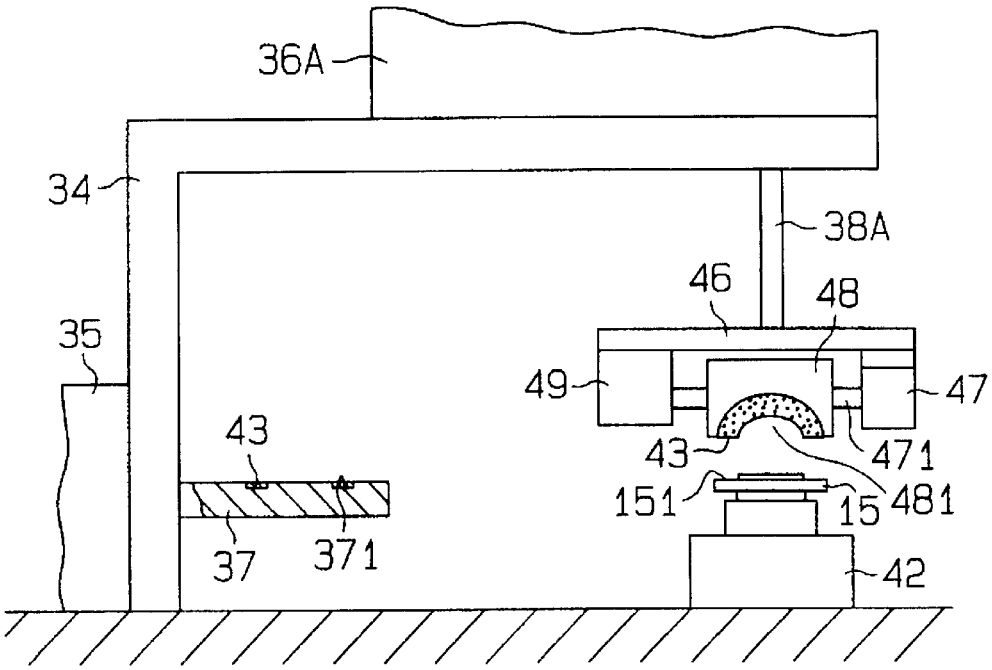
FIG. 5 is a partially omitted front view illustrating the second embodiment and the support shaft extending from the second driving device, at a position over a seat.
Figure 9:
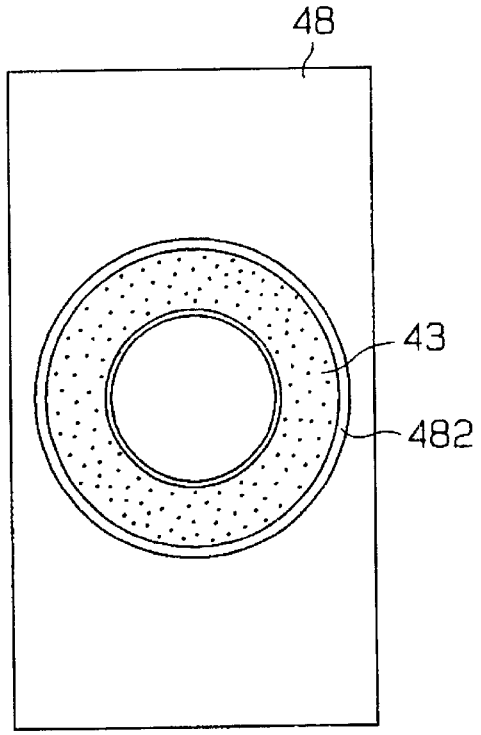
FIG. 9 is a development view of the peripheral surface of the absorption roller.

As shown in FIG. 4, a support base plate 46 is mounted beneath the bottom end of a support shaft 38A driven by a second driving device 36A, and a motor 47 is mounted beneath the bottom surface of the support base plate 46. An absorption roller 48 in a hollow body is mounted around an output shaft 471 of the motor 47. A concave portion 481, whose shape is appropriate to avoid the interference with the swash plate 15, is formed on the peripheral surface of the absorption roller 48. As shown in FIG. 9, when the peripheral surface of the absorption roller 48 is developed, the shape of the concave portion 481 is in a circle larger than a cylindrical base portion 154 of the swash plate 15.

Figure 6A:
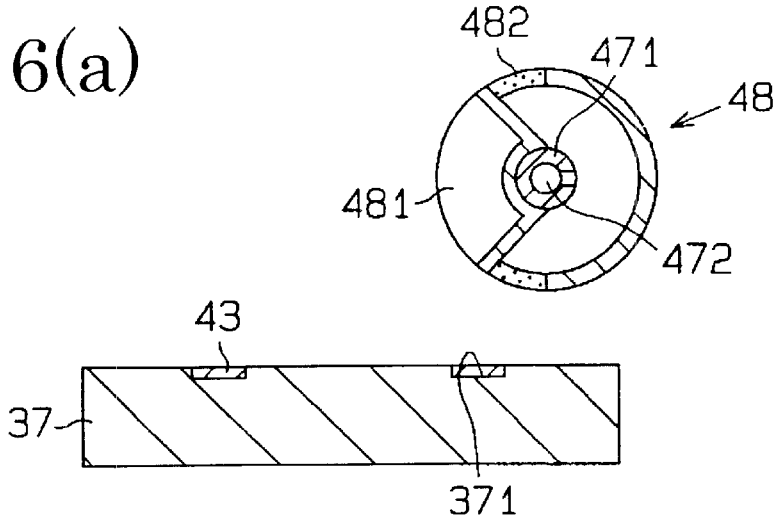
FIG. 6(*a*) is a cross-sectional view illustrating the condition before an absorption roller contacts a feeding plate.
Figure 6B:
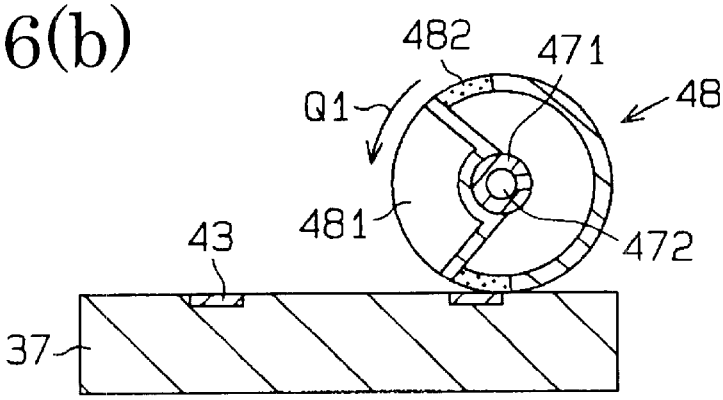
Figure 6C:
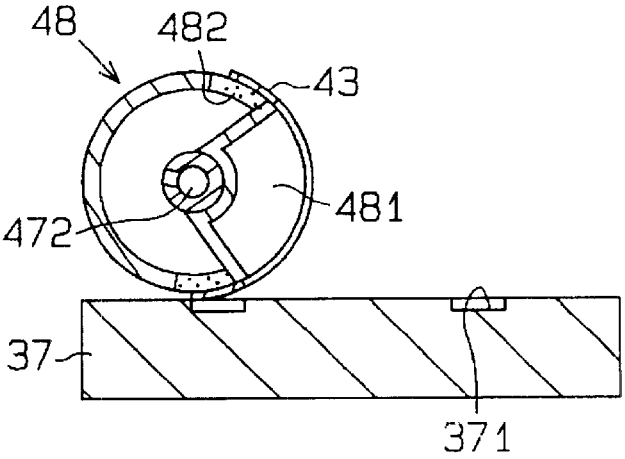
Figure 7A:
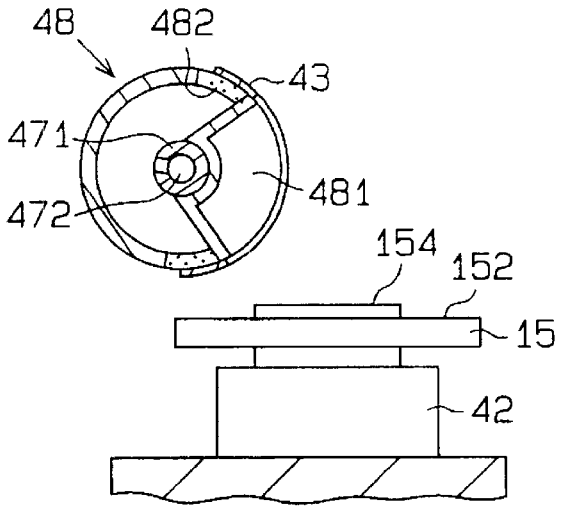
FIG. 7(*a*) is a cross-sectional view illustrating the condition before the absorption roller contacts a swash plate.
Figure 7B:
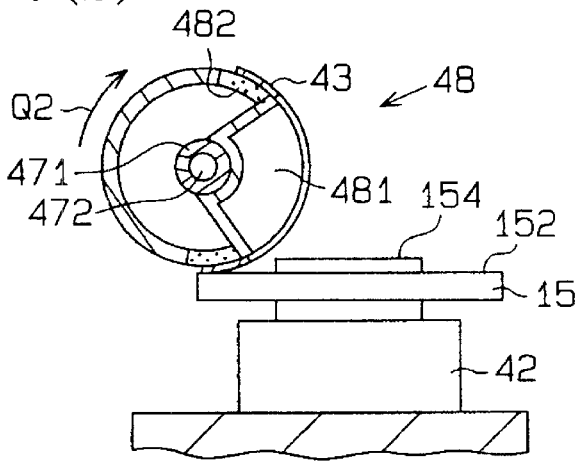
Figure 7C:
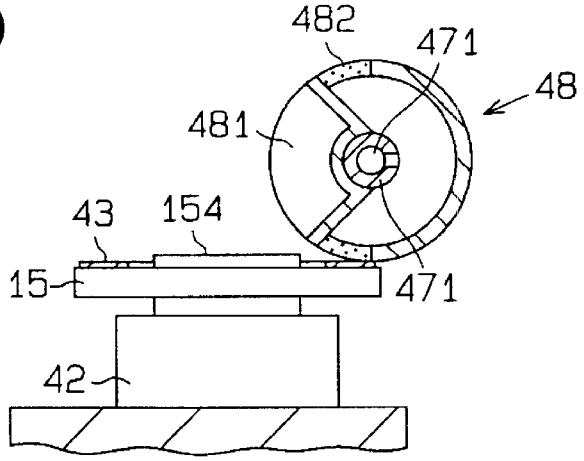
Figure 8:
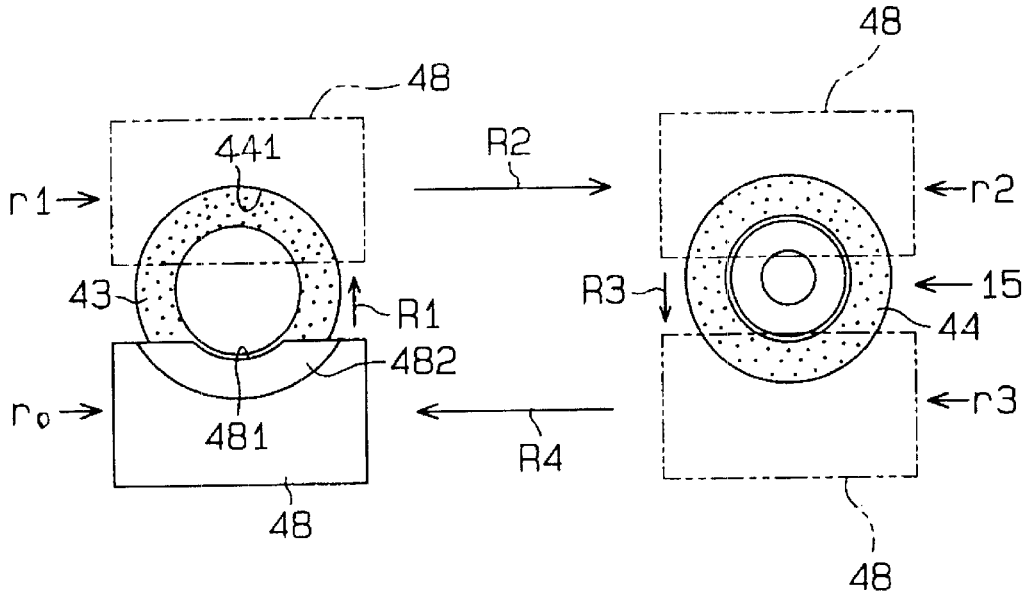
FIG. 8 is a schematic plan view illustrating the movement of the absorption roller.

As shown in FIGS. 8 and 9, an annular absorbing portion 482 is formed on the peripheral surface of the absorption roller 48. A developed plan of the peripheral surface of the absorption roller 48 is shown in FIG. 9. The absorbing portion 482 is made of a material having gas permeability. The absorbing portion 482 is almost the same in size as the sheet 43 prepared in a holding slot 441 shown in FIG. 8. As shown in FIG. 4, a blower 49 is mounted beneath the bottom surface of the support base plate 46. The blower 49 is connected to the output shaft 471, and a suction passage 472 (which is illustrated in FIGS. 6 and 7) is formed in the output shaft 471. The suction passage 472 connects to the hollow portion of the absorption roller 48. A sucking force is caused on the outer surface of the absorbing portion 482 when the blower 49 operates.

When the sheet 43 is prepared in the holding slot 441 as shown in FIG. 8 while the feeding plate 37 is at the feeding position as shown in FIG. 4, the absorption roller 48 is arranged at the predetermined height as shown in FIG. 6(*a*) and a solid line position r0 as shown in FIG. 8. Then the absorption roller 48 is lowered at the solid line position in FIG. 8, and press-contacts to the feeding plate 37 as shown in FIG. 6(*b*). The absorption roller 48 moves in the direction of an arrow R1 in FIG. 8 at a certain speed while the absorption roller 48 moves to the position in FIG. 6(*c*) with rotating in the direction of an arrow Q1 in FIG. 6(*b*) at a certain speed, and at the same time the blower 49 and the motor 47 operate with maintaining this contact. That is, the absorption roller 48 rotates so as to roll on the feeding plate 37. The moving speed of the absorption roller 48 is the same as its peripheral speed, and the absorbing portion 482 contacts the sheet 43 in the holding slot 441 with rolling. Accordingly, the sheet 43 in the annular holding slot 441 is transferred to the peripheral surface of the absorbing portion 482 as it is shown in FIG. 9, and then the motor 47 stops operating.

The absorption roller 48 absorbing the sheet 43 is raised to the above-mentioned predetermined height from the position in FIG. 6(*c*). That is, the absorption roller 48 is raised at the chain line position r1 in FIG. 8. The absorption roller 48 in FIG. 4 denotes this raised position. Next, the absorption roller 48 horizontally moves in the direction of an arrow R2 in FIG. 8. The absorption roller 48 is arranged at the above-mentioned predetermined height in FIG. 7(*a*) and at the chain line position r2 in FIG. 8 by the horizontal movement. The absorption roller 48 in FIG. 5 denotes the arranged position. Next, the absorption roller 48 is lowered at the chain line position r2 in FIG. 8, and press-contacts to the end surface 152 of the swash plate 15 as shown in FIG. 7(*b*). As shown in FIG. 8, the adhesive layer 44 is adhered to the end surface 152 of the swash plate 15 in advance. The absorption roller 48 moves in the direction of an arrow R3 in FIG. 8 at a certain speed while the absorption roller 48 moves to the position in FIG. 7(*c*) with rotating in the direction of an arrow Q2 in FIG. 7(*b*) at a certain speed, at the same time the motor 47 operates with maintaining this press-contact. The moving speed of the absorption roller 48 is the same as its peripheral speed. Therefore, the absorption roller 48 moves from the position in FIG. 7(*b*) to the position in FIG. 7(*c*) with rolling on the swash plate 15. The sheet 43 on the peripheral surface of the absorbing portion 482 of the absorption roller 48 is transferred and adhered to the end surface 152 of the swash plate 15, with the shape of the sheet 43 maintained. The base portion 154 of the swash plate 15 enters in the concave portion 481, so the base portion 154 does not interfere with the absorption roller 48.

The absorption roller 48, which adhered the sheet 43 to the swash plate 15, is raised to the above-mentioned predetermined height from the position in FIG. 7(*c*). That is, the absorption roller 48 is raised at the chain line position r3 in FIG. 8. Next, the absorption roller 48 moves horizontally in the direction of an arrow R4. By the horizontal movement, the absorption roller 48 is arranged at the above-mentioned predetermined height in FIG. 6(*a*) and at the solid line position r0 in FIG. 8. When the absorption roller 48 returns to the position in FIG. 6(*a*), a new sheet 43 is supplied in the holding slot 441 and the holding slot 441 is arranged at the preparing position S in FIG. 4. Then the sheet 43 is absorbed to the absorption roller 48, and the adhesion of the sheet 43 to another end surface 153 of the swash plate 15 or to a new swash plate 15 to be filmed are also performed in turn.

In the second embodiment the following effects can be obtained.

(2-1) The absorption roller 48 leaves from the feeding plate 37 and the swash plate 15, in every adhering operation of the sheet 43. Accordingly, a foreign substance does not continue to be absorbed to the absorption roller 48, even if the foreign substance is absorbed to the absorption roller 48 when the sheet 43 is adhered to the absorption roller 48, or, the foreign substance is absorbed to the absorption roller 48 when the sheet 43 is adhered to the swash plate 15. As a result, all the films 32 and 33 are not damaged by the foreign substance after the foreign substance is absorbed.

(2-2) The absorption roller 48, which rolls on the feeding plate 37 at the same peripheral speed as the moving speed of the absorption roller 48, absorbs the sheet 43 without creasing.

Furthermore, since the absorption roller 48 rolls on the swash plate 15 at the same peripheral speed as the moving speed of the absorption roller 48, the sheet 43 is adhered to the swash plate 15 without creasing. That is, the sheet 43 supplied in the holding slot 441 is adhered to the swash plate 15 with the shape of the sheet 43 maintained.

Accordingly, the excellent films 32 and 33 are obtained.

In the present invention the following embodiments can be applied.

(1) The piston 17 is applied as the constituent part to be filmed, and the peripheral surface of the piston 17 which slides on the peripheral surface of cylinder bore 111 is applied as the region to be filmed.

(2) After the sheet is adhered to the region to be filmed, the extra portion of the sheet is removed.

(3) The sheet is adhered to the region to be filmed with blanking process at the same time so as to fit the shape of the region.

(4) As disclosed in Japanese Unexamined Patent Publication No.11-193780, a metal sliding layer which is excellent in slidability is formed on the surface of the swash plate, and the film of the present invention is adhered thereon. The film can be a protective coat of the sliding layer.

(5) The present invention is applied to a swash plate of a fixed capacity type swash plate compressor.

As described above, in the present invention the film is formed by adhering the sheet to the region so as to fit the shape of the region, so the excellent effect that the film of a high quality is formed on the constituent part in the compressor can be performed.

Therefore the present examples and embodiments are to be considered as illustrative and not restrictive and the invention is not to be limited to the details given herein but may be modified within the scope of the appended claims.

What is claimed is:

1. A method for forming a film on a constituent part in a compressor, comprising:

adhering a solid sheet to the constituent part so as to fit the shape of a region where film is to be formed, wherein the solid sheet has been formed in advance to a predetermined thickness; and forming the film by subjecting the solid sheet to a calcination process.

2. A method for forming a film on a constituent part in a compressor according to claim 1, wherein said method further comprising:

forming the solid sheet so as to fit the shape of the region and thereafter adhering the fitted solid sheet to the region.

3. A method for forming a film on a constituent part in a compressor according to claim 1, wherein the method further comprising:

forming an adhesive layer on the region and adhering the solid sheet to the region through the adhesive layer.

4. A method for forming a film on a constituent part in a compressor according to claim 1, wherein the solid sheet comprises thermosetting resin containing a solid lubricant.

5. A method for forming a film on a constituent part in a compressor according to claim 1, wherein polishing is not performed after adhering the sheet.

6. A constituent part in a compressor, the constituent part being obtained by the step consisting essentially of adhering a solid sheet to form a film to the constituent part so as to fit the shape of a region where film is to be formed, wherein the solid sheet has been formed in advance to a predetermined thickness; and forming the film by subjecting the solid sheet to a calcination process.

7. A constituent part in a compressor according to claim 5, wherein the compressor is a swash plate type compressor comprising:

a housing having a plurality of cylinder bores;

a drive shaft rotatably supported by the housing;

a swash plate integrally rotatable with the drive shaft;

a piston accommodated in each of the cylinder bores; and a pair of shoes positioned between the swash plate and the piston for converting rotational movement of the swash plate to reciprocating movement of the piston, wherein the pair of shoes slides therebetween;

wherein the constituent part is the swash plate; and wherein region of the swash plate where film is to be formed are sliding regions to the pair of shoes.

* * * * *